US006335500B1

(12) United States Patent
Chi et al.

(10) Patent No.: US 6,335,500 B1
(45) Date of Patent: Jan. 1, 2002

(54) PUSH BUTTON TYPE OF SWITCH

(76) Inventors: Ching-Yu Chi, No. 6-1, Wen Hua Rd., Chih Shang Hsiang, Taitung Hsien; Chen-Fang Kao, 3F, No. 29, Lane69, Nei Hu Rd. sec. 1, Nei Hu Dist., Taipei, both of (TW)

( * ) Notice: Subject to any disclaimer, the term of this patent is extended or adjusted under 35 U.S.C. 154(b) by 0 days.

(21) Appl. No.: 09/702,799

(22) Filed: Nov. 1, 2000

(51) Int. Cl.[7] ..... H01H 13/14

(52) U.S. Cl. ..... 200/341; 200/523; 200/520; 200/314

(58) Field of Search ..... ; H01H 13/14

(56) References Cited

U.S. PATENT DOCUMENTS 3,491,220 A * 1/1970 Mitchell et al. ..... 200/167
3,776,049 A * 12/1973 Emery ..... 74/110
3,789,173 A * 1/1974 Bury ..... 200/153 J
5,521,347 A * 5/1996 Imaeda et al. ..... 200/525

* cited by examiner

*Primary Examiner*—Michael Friedhofer
(74) *Attorney, Agent, or Firm*—Bacon & Thomas

(57) ABSTRACT

A push button type switch comprises a body and drive means. The body has a hollow interior portion that is formed as two operation spaces by a spacing portion with a through hole thereon. The two spaces each being arranged with a press element having a protrusion enclosing with an operation area and a plurality of conductive elements same ends of which have respective switching element. The driving means include a depressing element connected to the operation area and has an end passing through the through hole of the spacing portion. An elastic element covers on the pressing element and has an end connected to the spacing portion; and a rotary seat is pivotally installed on the body and has a guide groove for supporting the depressing element. One end of the rotary seat has a positioning portion connected to the switching means so that as a force applies to the pressing element. The depressing element is pressed to compress the elastic element, and another end of the depressing element resists against the guide groove so that the rotary seat shifts to drive the switching means to conduct the conductive elements. By the restoring elastic force of the elastic element, the pressing element and the depressing element are restored to the original condition.

11 Claims, 6 Drawing Sheets

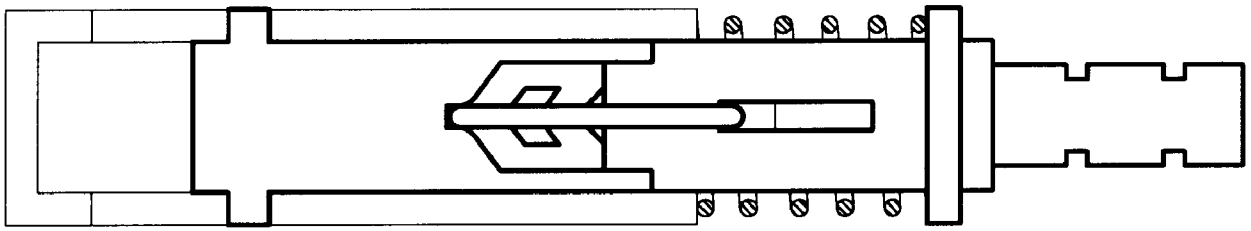
PRIOR ART Fig. 1A

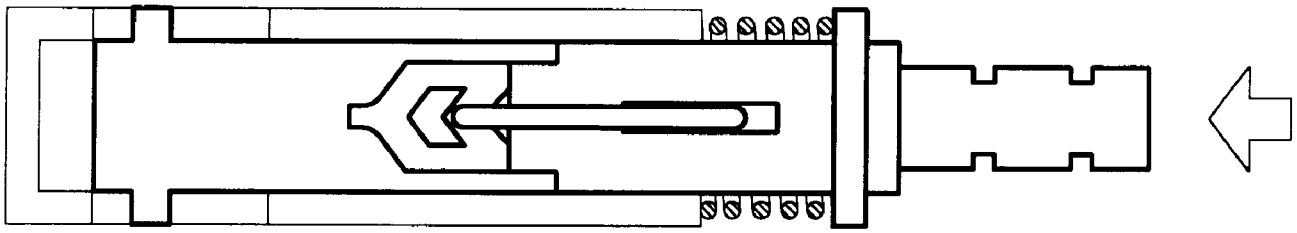
PRIOR ART Fig. 1B

PUSH BUTTON TYPE OF SWITCH

BACKGROUND OF THE INVENTION

The present invention relates to a push button type switch, wherein the pressing element retains in an initial position despite the condition of the switch so as to be formed as a complete opening and closing loop.

The push button type switch of the current electronic products, as shown in FIGS. 1A and 1B, has a casing with a control rod slidable in the casing. An elastic element is installed between the control rod and an end surface of the casing. A plurality of confining blocks as a sliding guiding surface is formed on the control rod so as to be formed as a track guide. An elastomer displacing along the track guide is formed on the control rod. The control rod moves downward to press the elastic element and then to drive the elastomer to be moved along the track guide to a center confining block for positioning thereon. A driven piece connected to another end of the control rod will press contact pieces to cause terminals to be conductive, and then a force is applied to the control rod again so that it is moved along the track guide to the initial position. Then, the driven piece is driven synchronously to separate from a pressing position of the contact piece, and thus, the circuit is opened. However, the prior art push button type switch has the following disadvantages:

1. The parts of the push button type switch can not be easily assembled. As the elastomer moves in the track guide, the confining blocks are often worn so that the elastomer will deform or the confining block wears so that as the control rod is pressed downwards, the control rod can not substantially press the contact piece for controlling the opening and closing of the switch.
2. As the control rod is depressed to be positioned in the confining block, it can not restore to the initial condition, while at next time, as it is pressed for restoring to the initial condition, the switch is opened. Therefore, the operation is inconvenient. The push button type switch has on displaying device. The user can not determine the condition of the switch. Moreover, the contact piece is made of a single metal piece with only one thermal extension coefficient. Thus, the object of overload protection can not achieve. As a result, the applications are confined.

SUMMARY OF THE INVENTION

Accordingly, the primary object of the present invention is to provide a push button type switch, wherein the pressing element retains in an initial position despite the condition of the switch so as to be formed as a complete opening and closing loop.

Another object of the present invention is to provide a push button type switch, wherein a display lamp set is further installed for informing the user the condition of the current switch.

A further object of the present invention is to provide a push button type switch, wherein the contact piece is formed by two metal pieces with different extension coefficients for achieving the effect of over current or over voltage protection.

BRIEF DESCRIPTION OF FIGURES

Embodiments of the present invention will hereinafter be described, by way of example, with reference to the accompanying drawings, in which:

FIGS. 1A and 1B are schematic views of the prior art push button type switch.

DESCRIPTION OF PREFERRED EMBODIMENTS

Figure 2:
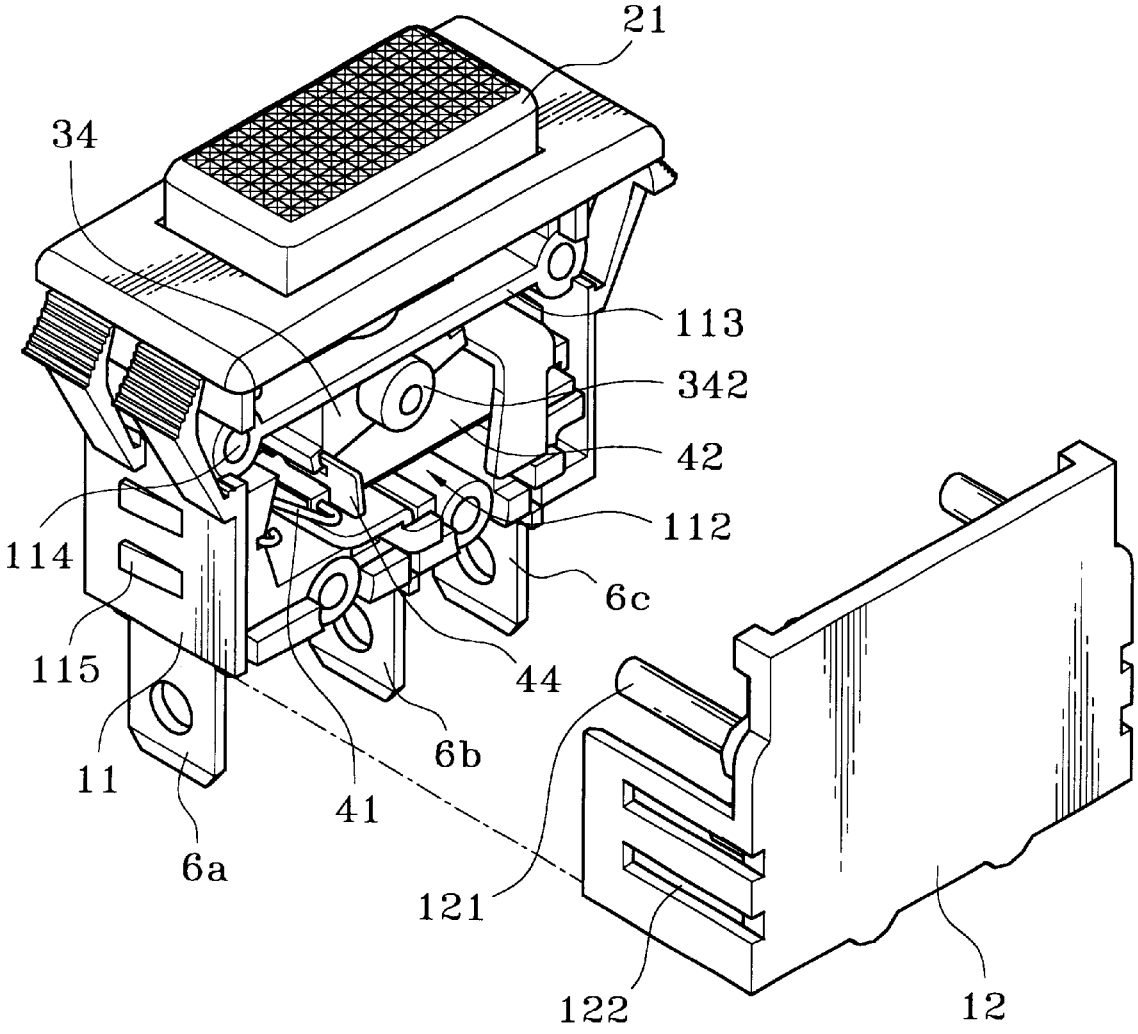
FIG. 2 is a schematic perspective view of the present invention.
Figure 3:
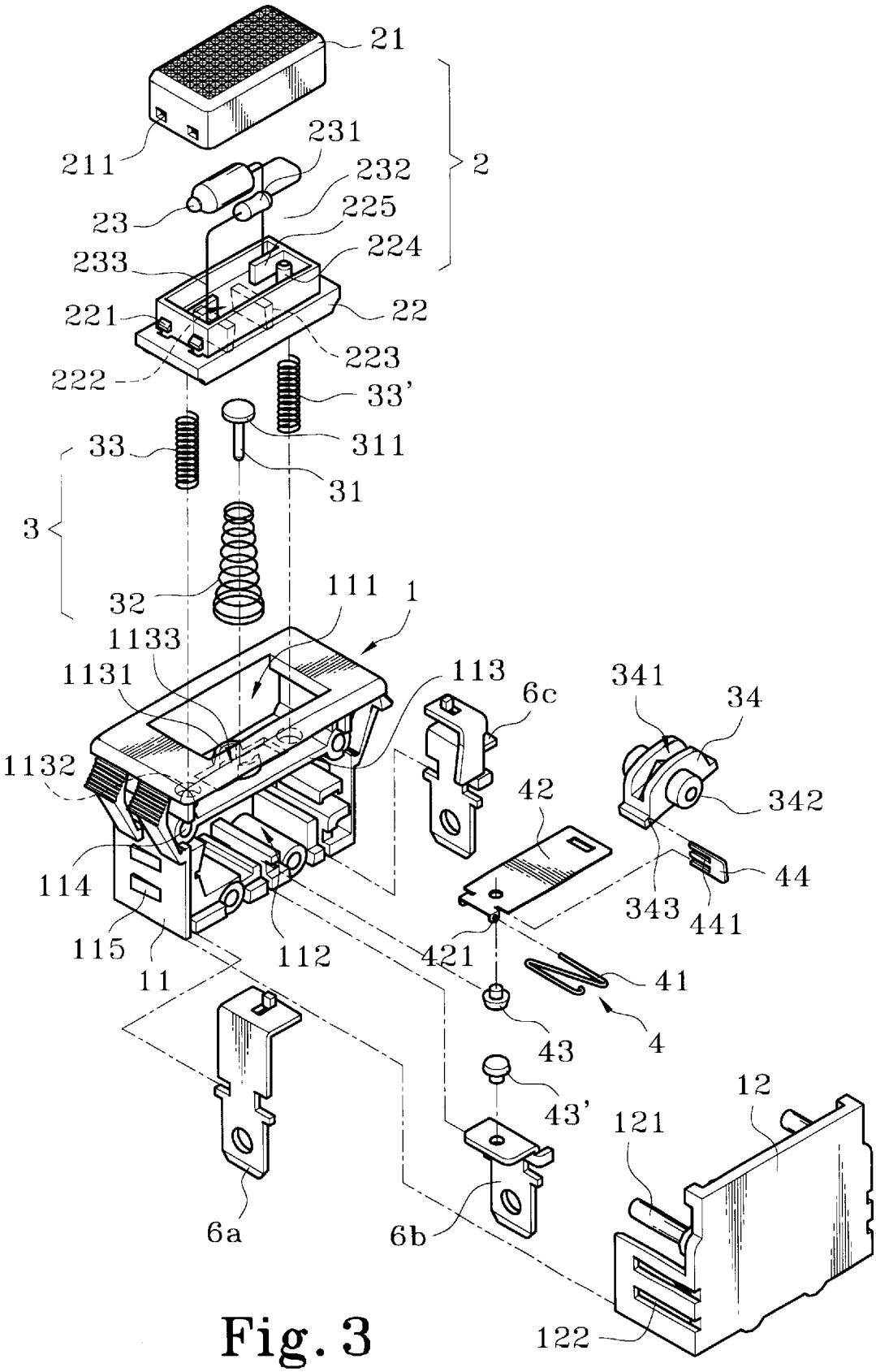
FIG. 3 is an exploded perspective view showing the structure of the present invention.

With reference to FIGS. 2, 3 and 4, the perspective view and the exploded schematic view of the present invention are illustrated. The push button type switch of the present invention includes a body 11. One side of the body 11 has an opening for being assembled with a sealing piece 12. The body 11 and sealing piece 12 are installed with matched posts 121, positioning holes 114 and ear portions 115 and buckle holes 122 for being formed with a switch seat 1. The body 11 has a hollow inner portion. The portion is spaced as two operation spaces 111, 112 by the spacing 113 with through hole 1133. The spacing 113 is integrally formed the body 11. A protrusion 223 is installed with a pressing element 2 formed with an operation section 222 by the protrusion 223 and a plurality of conductive elements 6*a,* 6*b,* and 6*c* connected to the switch element 4. The pressing element 2 includes a housing 21 with buckle hole 211 at the periphery and a supporting seat 22 with a buckle hole 221 with respect to the buckle hole 211 for forming the housing 21. Two ends of the supporting seat 22 and the conductive elements 6*a,* 6*b,* and 6*c* at two sides of the body 11 are formed two auxiliary elastic elements 33, 33'. A display lamp set 23 is arranged on the supporting seat 22. The display lamp set 23 has pins 232, 233 which are connected to resistor 231. Then, a spacer 225 and post 224 serve to space it for passing through the through hole 1132 and then is connected to the auxiliary elastic elements 33, 33' so that the push button type switch is closed. The current passes through the conductive elements 6*a,* 6*b,* and 6*c* to the auxiliary elastic elements 33, 33' and then passes through the display lamp set 23 (the display lamp set 23 is a neon lamp set) so as to emit light. The housing 21 is made of transparent material in order to inform the user the condition of the lamp. A driving means 3 is installed within the body 11, which is includes a depressing element 31 connected to the operation section 222 and an elastic element 32 installed in the depressing element 31 and having an end connected to a engaging portion 1131 of the spacing portion 113, and a rotary seat 34 with an axial connecting portion 342 for being pivotally installed to the body 11 and having a guide groove 341 for resisting against the depressing element 31. One end of the rotary seat 34 is installed with a positioning portion 343 connected to a switching element 4. Besides, the switch element 4 has a contact piece 42 connected to the conductive elements 6*c*. Another end of the contact piece 42 is installed with a combining portion 421 which is made of metal wire. A swingable piece 43 with two notches 441 is installed between the contact piece 42 and the rotary seat 34. The contact piece 42 has another end being installed with joints 43, 43' with respective to the conductive elements 6*b*. The contact piece 42 is made of a metal piece with two different extension coefficients (bi-metal). In the present invention, when voltage or current is over the predetermined values, then the contact piece 42 heats due to resistivity. The metal piece with a low extension coefficient will bend to force the contact piece 42 to bend so that the present invention is tripped to be in an open condition (from the closing condition of FIG. 4C to the opening condition of FIG. 4A) so as to achieve the object the overload protection.

Figure 4A:
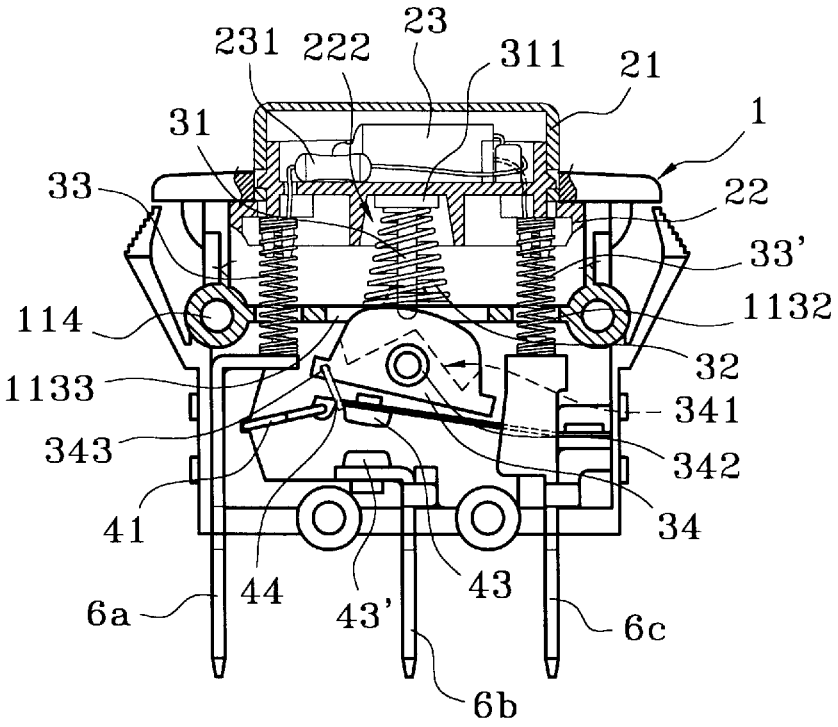
FIGS. 4A, 4B, 4C and 4D are assembled schematic views of the present invention.
Figure 4B:
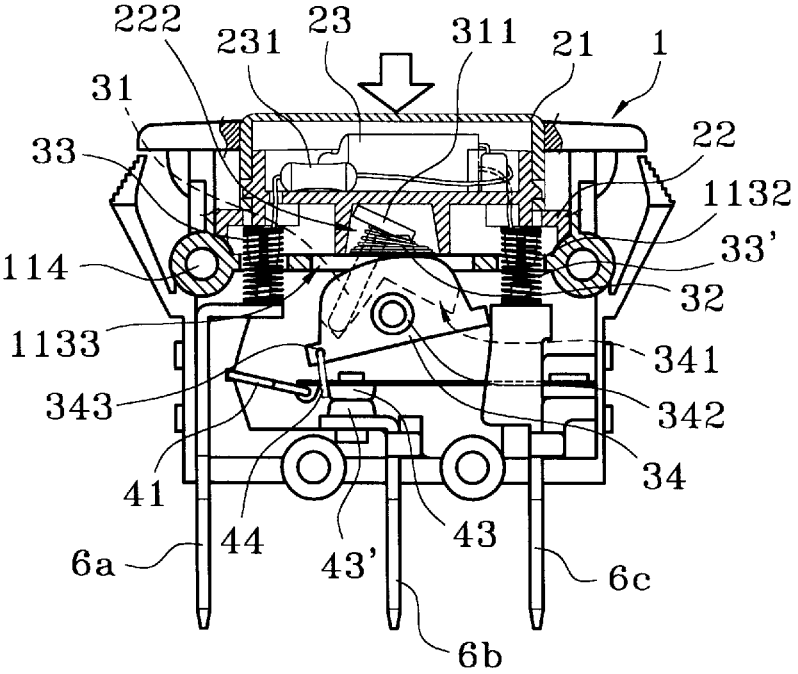
Figure 4C:
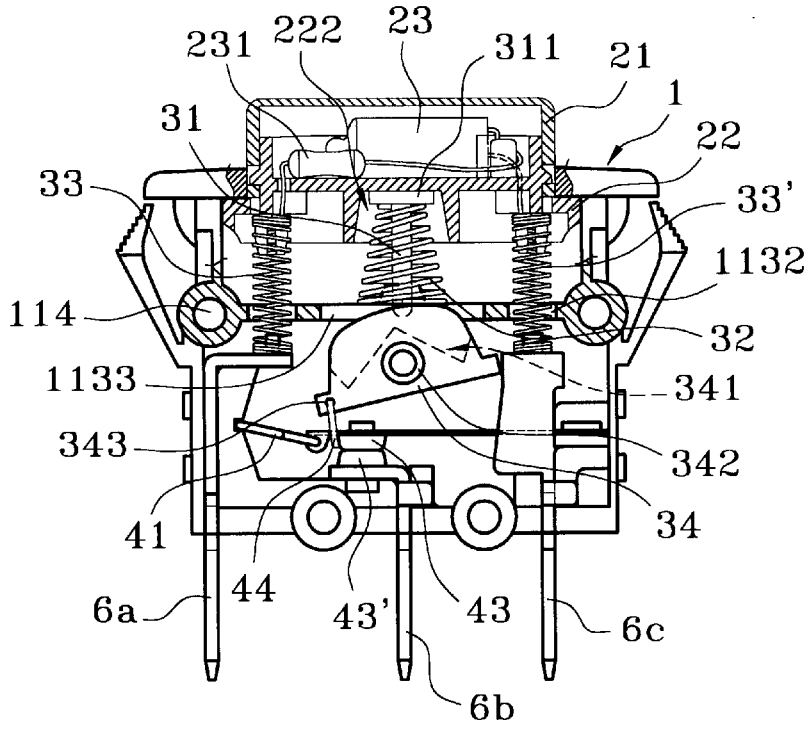
Figure 4D:
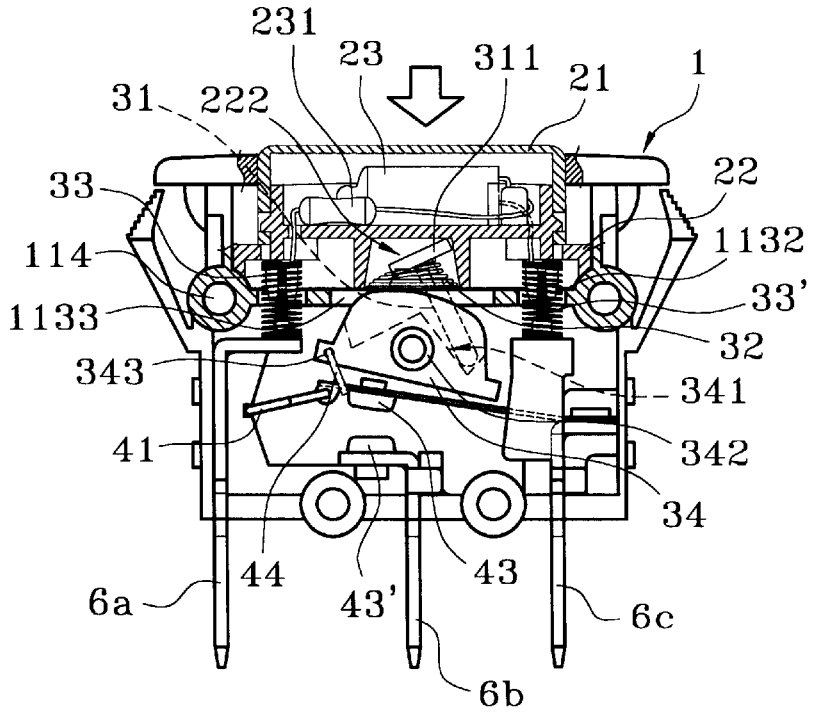

In the present invention, the conductive elements 6*a,* 6*b,* and 6*c* are terminals or pins. With reference to FIG. 4*a,* the schematic view shows the initial condition of the present invention. When the user applies a force to the housing 21 of the pressing element 2 for driving the supporting seat 22 to move downwards. The elastic element 32 of the driving means 3 is a spring with a wider lower portion. The top of the depressing element 31 is formed with a head 311 having an outer diameter larger than the elastic element 32. As the depressing element 31 is pressed by the pressing element 2 to move downwards to press the elastic element 32. Then, since the guide groove 341 of the rotary seat 34 are inclined or have a round arc shape from the center to the two ends. The depressing element 31 is shifted along the track of the guide groove 341. The head 311 of the depressing element 31 will not separate due to the confinement of the protrusion 224 of the operation area 222. The rotary seat is pressed by the shift of the depressing element 31 and then rotates so that the swingable piece 43 at the same end of the rotary seat 34 will drive the contact piece 42 to move downwards. By the pressing of the elastic body 41, the joint 43 of the contact piece 42 is connected to another joint 43' on the conductive elements 6*b* so as to be formed as a closing condition (as shown in FIG. 4). When the outer force is removed, the elastic element 32 and the auxiliary elastic element 33, 33' at two sides of the supporting seat 22 restore the elasticity so as to drive the press element 2 and the depressing element 31 to restore to the initial position. Now, the push button type switch remains in a closing condition (FIG. 4C). When the user applies a force to the pressing element 2 again, then the depressing element 31 is driven to move along the track at another end of the guide groove 341 so as to drive the rotary seat 34 to move in a reverse direction and cause the swingable piece 44 to guide the contact piece 42 to move upwards so as to be formed as an open condition (as shown in FIG. 4D). As the outer force disappears, by the restoring elastic forces of the elastic element 32 and the auxiliary elastic element 33, 33', the pressing element 2 and the depressing element 31 are restored to the original position.

It will also be appreciated that other modifications and variations may be made to the embodiments as described and illustrated within the scope of the present application as defined in the following claims.

We claim:

1. A push button type switch comprising:

a body having a hollow interior portion which is divided into two operation spaces by a spacer having a through hole therein;

a pressing element situated in a first of said operation spaces, said pressing element having protrusions extending from an operation section of the pressing element;

a switching element situated in a second of said operation spaces;

a plurality of conductive elements having first ends arranged to respectively engage the switching element and thereby establish an electrical connection between said conductive elements; and driving means including a depressing element positioned between said protrusions and connected to the operation section, said depressing element having an end passing through the through hole of the spacer; an elastic element surrounding the pressing element and having an end connected to the spacer; and a rotary seat pivotally installed on the body and having a guide groove for supporting the depressing element; one end of the rotary seat having a positioning portion connected to the switching element, wherein as a force is applied to the pressing element, the depressing element is pressed to compress the elastic element, wherein another end of the depressing element engages the guide groove so that the rotary seat shifts to drive the switching element to electrically connect the conductive elements, wherein by the restoring elastic force of the elastic element, the pressing element and the depressing element are restored to the original condition, and wherein the switching element has a contact piece having an end connected to the conductive elements; another end of the contact piece is connected to an elastic body firmly secured to the body, and a swingable piece is connected between the contact piece and the rotary seat.

2. The push button type switch as claimed in claim 1, wherein one side of the body has an opening for being assembled with a closing element so as to be formed as a switch seat, and the body and the closing element are matched with positioning posts, positioning holes and ear portions and buckling holes at two respective ends.

3. The push button type switch as claimed in claim 1, wherein the pressing element includes a housing and a supporting seat supporting the housing.

4. The push button type switch as claimed in claim 3, wherein two ends of the supporting seat are assembled with two auxiliary elastic element.

5. The push button type switch as claimed in claim 3, wherein the supporting seat is arranged with a display lamp set; and the housing is made of transparent material.

6. The push button type switch as claimed in claim 1 wherein the another end of the contact piece and the respective conductive elements are arranged with joints.

7. The push button type switch as claimed in claim 1, wherein the elastic body is made by bending a metal steel wire.

8. The push button type switch as claimed in claim 1, wherein the contact piece is made by two metal pieces with different heat extension coefficients.

9. The push button type switch as claimed in claim 1, wherein the depressing element has a top edge having a head, and an outer diameter of the head is larger than that of a head of the elastic element.

10. The push button type switch as claimed in claim 1, wherein the guide groove of the rotary seat is inclined from a center to two ends according to a preset angle.

11. The push button type switch as claimed in claim 1, wherein the guide groove of the rotary seat has a round arc shape.

* * * * *